US007568685B2

(12) United States Patent
Silberbauer

(10) Patent No.: US 7,568,685 B2
(45) Date of Patent: Aug. 4, 2009

(54) METHOD FOR MANUFACTURING PRINTED PRODUCTS SUCH AS BOOKS, BROCHURES, MAGAZINES OR THE LIKE

(75) Inventor: Günther Silberbauer, Uerkheim (CH)

(73) Assignee: Müller Martini Holding AG, Hergiswil (CH)

( * ) Notice: Subject to any disclaimer, the term of this patent is extended or adjusted under 35 U.S.C. 154(b) by 68 days.

(21) Appl. No.: 11/048,065

(22) Filed: Feb. 2, 2005

(65) Prior Publication Data

US 2005/0167901 A1 Aug. 4, 2005

(30) Foreign Application Priority Data

Feb. 2, 2004 (EP) ..... 04405062

(51) Int. Cl.
*B65H 37/04* (2006.01)

(52) U.S. Cl. ..... 270/58.07; 270/52.18; 270/52.14; 270/58.23

(58) Field of Classification Search ..... 270/52.14, 270/52.16, 52.18, 58.07, 58.08, 58.23, 58.29
See application file for complete search history.

(56) References Cited

U.S. PATENT DOCUMENTS 5,316,425 A * 5/1994 Graushar et al. ..... 412/19
5,678,813 A * 10/1997 Osako et al. ..... 270/52.16
6,224,048 B1 * 5/2001 Motamed ..... 270/52.02
2002/0089111 A1 * 7/2002 Tsuchiya et al. ..... 270/58.08

FOREIGN PATENT DOCUMENTS

| | | | |
|---|---|---|---|
| DE | 360 378 | C | 10/1922 |
| DE | 12 65 763 | B | 4/1968 |
| DE | 27 40 320 | A1 | 3/1978 |
| DE | 100 05 052 | A1 | 8/2001 |
| DE | 203 07 461 | U1 | 10/2003 |

* cited by examiner

*Primary Examiner*—Gene Crawford
*Assistant Examiner*—Leslie A Nicholson, III
(74) *Attorney, Agent, or Firm*—Venable LLP; Robert Kinberg; Ryan M. Flandro

(57) ABSTRACT

A method for manufacturing a printed product formed from a plurality of printed sheets which are printed sequentially for processing, wherein the printed products each comprise at least one printed sheet and an additional sheet which are stacked together in a stacking apparatus. The method includes feeding the additional sheet to the at least one printed sheet on a conveying path of a first conveying apparatus to the stacking apparatus.

10 Claims, 1 Drawing Sheet

METHOD FOR MANUFACTURING PRINTED PRODUCTS SUCH AS BOOKS, BROCHURES, MAGAZINES OR THE LIKE

CROSS-REFERENCE TO RELATED APPLICATION

This application claims the priority of European Patent Application No. 04405062.3-2304, filed on Feb. 2, 2004, the subject matter of which is incorporated herein by reference.

BACKGROUND OF THE INVENTION

The invention relates to a method for manufacturing printed products which are formed from a plurality of printed sheets (S) which are printed sequentially for processing, such as books, brochures, magazines or the like, comprising at least one printed sheet and an additional sheet which are stacked together in a stacking apparatus. The invention additionally relates to a device for carrying out the method.

The manufacture of books from printed sheets and additional sheets is known. The additional sheet is, for example, a sheet having a flap or a pocket. Sheets of this type have to be processed separately and therefore cannot be printed in a conventional printing press like the printed sheets and subsequently folded in a folding apparatus. The additional sheet can also be a colour-printed sheet which has been printed in a further printing press. Additional sheets having embossing, a perforation, an inserted chip or the like are also conceivable. It has previously been customary to add additional sheets of this type by hand to a book block which has not yet been bound. This is comparatively complicated, as it must be ensured, in particular, that the additional sheet is introduced at the correct location in the book block.

A method is known in which an insert, for example a card, is introduced into a book. This is manufactured using a collating machine comprising a plurality of feeders. At least one of the feeders has the card which is to be introduced in a cassette, which card is then pulled out of the cassette using the feeder drum and added to the book block which is being formed. When the book block has been formed, it is bound and subsequently trimmed. This method makes it possible to insert cards automatically into a book, for example into a magazine. It is also known to provide cards of this type with an adhesive during the drawing-off operation. This method requires a collating machine and appropriate feeders. However, it is not suitable for a method in which printing is carried out sequentially using a digital printing press. The sequential printing of printed sheets using a digital printing press has the particular advantage that it is also possible to manufacture small runs inexpensively.

SUMMARY OF THE INVENTION

The invention is based on the object of providing a method of the type mentioned in the introduction, which method makes it possible, even in the case of sequential printing using a digital printing press, to insert at least one additional sheet inexpensively and with low outlay on personnel.

In a method according to the generic type, the object is achieved in that the additional sheet is fed to the printed sheet on the conveying path of a first conveying apparatus to the stacking apparatus. In the method according to the invention, the additional sheet is therefore added to a single printed sheet and thus not introduced at the provided location into the book block which is already formed, as was previously the case. The product comprising the single printed sheet and the additional sheet is then stacked to form the book block like the customary other printed sheets. The book block with the inserted additional sheet can then be processed in the conventional manner, in particular bound, for example adhesively bound and trimmed. The book can be a conventional book, a magazine, brochure or the like. It is also readily possible to insert a plurality of additional sheets. For example, one additional sheet can have a flap and another additional sheet can be colour-printed or, for example, have embossing or a hologram. The method is not restricted to sequential printing, but is preferably used in such a method.

One substantial advantage of the method according to the invention is the great flexibility in manufacturing books or book blocks. The additional sheets and the printed sheets can be changed without great conversion work, with the result that it is possible to manufacture high-quality books inexpensively, even in relatively small runs.

According to one development of the invention, there is provision for the additional sheet to be pulled from a stack by a feeder and subsequently added to the single printed sheet. This method makes particularly great automation and performance possible.

According to one development of the invention, there is provision for the additional sheet to be fed to a second conveying apparatus and added by the latter to a single printed sheet which is conveyed sequentially by a first conveying apparatus. Here, the second conveying apparatus is preferably loaded with a feeder. It is possible here to use a plurality of feeders of this type which each transfer an additional sheet to the second conveying apparatus. It is thus possible to form a book block with a plurality of different additional sheets and to provide them at various locations in a book block. Here, the additional sheet is preferably fed to the printed sheet which is transported by the first conveying apparatus, for example after a folding apparatus but before the stacking apparatus.

According to one development of the invention, there is provision for a joining means to be applied to the additional sheet, for example a sheet of smaller dimensions, before it is added to the printed sheet. The joining means is, for example, a glue, an adhesive or a staple. It can thus be ensured that the additional sheet is positioned reliably on the printed sheet and its position with regard to the printed sheet can no longer change. A product is thus made from a printed sheet and an additional sheet, which product does not change even during subsequent conveying. This also makes it possible for the additional sheet to be exactly positioned in the book block or in the completed book. This method is particularly efficient when the additional sheet has a smaller format or is to be arranged at a special location on the printed sheet. The additional sheet is therefore positioned accurately before the book block is formed. The joining between the printed sheet and the additional sheet can also be temporary.

According to one development of the invention, glue or an adhesive is applied to the additional sheet, for example using a spray can. The additional sheet is placed onto the single printed sheet directly afterwards and joined to the printed sheet by the glue or adhesive.

In addition, the invention relates to a device for carrying out the method. The device has a first conveying apparatus for the printed sheets and a stacking apparatus for forming a book block. In a device of this type, there is provision according to the invention to have a second conveying apparatus, by which it is possible to add an additional sheet to a single printed sheet which has been transported by the first conveying apparatus.

According to one development of the invention, a digital printing press by the printed sheets are printed sequentially can be joined upstream of the first conveying apparatus.

DETAILED DESCRIPTION OF THE INVENTION

Figure 1:
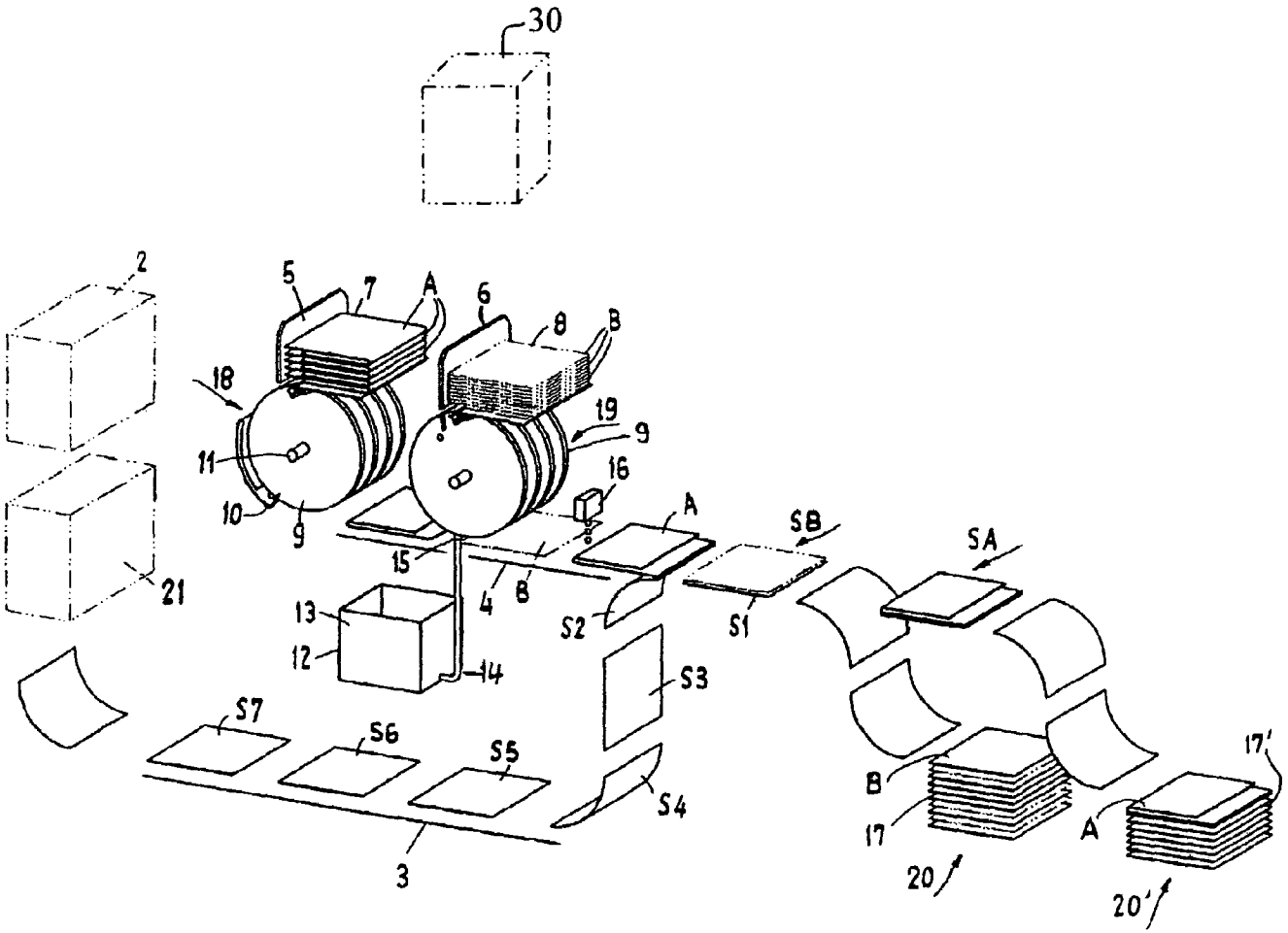
FIG. 1 is a schematic drawing illustrating the method and apparatus according to the invention.

In the following text, an exemplary embodiment of the invention will be explained using the single FIGURE. This FIGURE diagrammatically shows a three-dimensional view of a device according to the invention.

Referring to FIG. 1, there is shown a device 1 which has a printing press 2, preferably a digital printing press, by which it is possible to print sequentially. A folding apparatus 21 is arranged behind printing press 2, in which printed sheets S are folded with a transverse fold in a manner known per se. These printed sheets S are transferred sequentially to a first conveying apparatus 3. FIG. 1 shows printed sheets S1 to S7 which are printed differently and which produce, for example, a magazine.

Device 1 has a second conveying apparatus 4. Additional sheets A and B are conveyed by the said second conveying apparatus 4 and, as can be seen, fed to the first conveying apparatus 3. The additional sheets A and B may also have been printed by a digital printing press 30 and are each pulled off from a stack 7 or 8 by a feeder 18 or 19 and deposited onto the second conveying apparatus 4. The feeders 18 and 19 can be drum feeders which are known per se and each have a drum 9 which is driven about an axis 11. The drums 9 have grippers 10, by which in each case one additional sheet A or B is pulled off from the stack 7 or 8 and deposited downwards onto the second conveying apparatus 4. The stacks 7 and 8 are stored in a cassette 5 and 6, respectively. The cassettes 5 and 6 can be loaded by hand or machine.

An adhesive, in particular a glue, is applied to the additional sheets A and B using an apparatus 12. Apparatus 12 has a pot 13, from which glue is fed via a line 14 to a nozzle 15 or another application means. When required, the glue is sprayed by nozzle 15 onto the underside of an additional sheet A or B. The glue is preferably a hot glue. Application can be punctiform or as desired. It goes without saying that the glue is applied only to additional sheets A and B which make it possible and, in particular, are not printed at the appropriate locations. The region of the applied adhesive can be removed later, for example during adhesive binding. The apparatus is controlled by a control apparatus (not shown here).

Another control apparatus (not shown) is connected to a sensor 16 which determines the position of the additional sheet A or B by signals and controls the conveying apparatus so that it is ensured that the additional sheets A or B meet a printed sheet S at the desired location.

The first conveying apparatus 3 is loaded with the additional sheets A or B by the second conveying apparatus 4. Here, a single printed sheet S1 or S2 is guided onto an additional sheet A or B from below or from above. As can be seen, the printed sheets S1 and S2 are moved from below in an arc into the plane of the second conveying apparatus 4. The additional sheet A or B forms a product SA or SB with the appropriate printed sheet S1 or S2, which product SA or SB is conveyed further sequentially with the remaining printed sheets S. In this product SA or SB, the additional sheet A or B is immovably joined to the appropriate printed sheet S1 or S2 in the event of glue application. During the further processing, the additional sheet A or B can no longer be displaced with respect to the printed sheet S1 or S2. A refinement is also conceivable in which the printed sheets S1 or S2 are mechanically joined to the appropriate additional sheet A or B, for example by thread stitching.

The printed sheets S and the products SA and SB are stacked in a stacking apparatus 20 to form a book block 17. The book block 17 therefore contains the printed sheets S1 to S7 and the additional sheets A and B in the desired order. The book block 17 is then bound in a manner known per se and subsequently trimmed. Here, the book block 17 can be provided with a cover (not shown here). All types of binding are possible, for example adhesive binding, thread stitching and the like.

As shown, two or more than two stacking apparatuses 20 and 20' are also possible, different book blocks 17 and 17' being formed in the stacking apparatuses 20 and 20', respectively. In the exemplary embodiment shown, a book block 17 having three additional sheets B is formed in the stacking apparatus 20 and a book block 17' having one additional sheet A is formed in the stacking apparatus 20'. It is readily possible here without complicated conversion work to form a book block which has both an additional sheet A and an additional sheet B. The printed sheets S can likewise be changed in a simple manner.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A method for manufacturing a book block, the method comprising:

feeding a plurality of printed sheets sequentially on a first conveying path of a first conveying apparatus;

feeding a first additional sheet on a second conveying path of a second conveying apparatus that merges with the first conveying path prior to a stacking apparatus;

applying a joining mechanism to the first additional sheet before the first and second conveying paths merge;

joining the first additional sheet to one of the printed sheets at the merger of the first and second conveying paths and prior to the stacking apparatus, wherein the first additional sheet joined to the one printed sheet defines a printed product; and stacking a plurality of the printed sheets and the printed product in the stacking apparatus to form the book block.

2. The method according to claim 1, further including:

feeding a second additional sheet on the second conveying path;

applying a joining mechanism to the second additional sheet before the first and second conveying paths merge;

joining the second additional sheet to another one of the printed sheets at the merger of the first and second conveying paths and prior to the stacking apparatus, wherein the second additional sheet joined to the another printed sheet define a second printed product; and stacking the second printed product in the stacking apparatus.

3. The method according to claim 1, including using a digital printing press to print the printed sheets.

4. The method according to claim 1, further comprising pulling the first additional sheet from a stack by a feeder.

5. The method according to claim 1, wherein the first additional sheet is printed by a digital printing press.

6. A method for manufacturing a book block, comprising:

feeding printed sheets sequentially on a first conveying path of a first conveying apparatus from a printing press to a stacking device;

feeding additional sheets on a second conveying path of a second conveying apparatus which second conveying path merges with the first conveying path prior to the stacking device;

applying a joining mechanism to each additional sheet before the first and second conveying paths merge;

attaching each additional sheet to a respective selected printed sheet on the first conveying path prior to the stacking device to define a printed product;

conveying in a predetermined order the printed products and the printed sheets by the first conveying apparatus to the stacking device; and forming the book block in the stacking device with the conveyed printed products and the printed sheets.

7. The method according to claim 6, wherein the selected printed sheet includes a cover sheet and further including:

attaching the additional sheet to an inner surface of the cover sheet.

8. The method according to claim 7, wherein feeding additional sheets includes feeding at least one of: a hologram, a pocket, or a flap.

9. A device for manufacturing a book block, the device comprising:

a first conveying apparatus for feeding a plurality of printed sheets sequentially on a first conveying path to a stacking apparatus;

a second conveying apparatus for feeding additional sheets on a second conveying path that merges with the first conveying path prior to the stacking apparatus;

an adhesive station arranged along the second conveying path of the second conveying apparatus for applying a joining mechanism to each of the additional sheets before the first and second conveying paths merge so that each of the additional sheets can be joined to one of the printed sheets at the merger of the first and second conveying paths and prior to the stacking apparatus, wherein each one of the additional sheets joined to one of the printed sheets defines a printed product; and a stacking apparatus for stacking the printed sheets and the printed products to form the book block.

10. The device according to claim 9, further including:

a digital printing press disposed upstream of the first conveying apparatus and configured for a sequential processing of the printed sheets.

* * * * *

UNITED STATES PATENT AND TRADEMARK OFFICE

CERTIFICATE OF CORRECTION

PATENT NO. : 7,568,685 B2
APPLICATION NO. : 11/048065
DATED : August 4, 2009
INVENTOR(S) : Günther Silberbauer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 228 days.

Signed and Sealed this

Seventh Day of September, 2010

David J. Kappos

David J. Kappos
*Director of the United States Patent and Trademark Office*